US009957850B2

(12) United States Patent
Oh et al.

(10) Patent No.: US 9,957,850 B2
(45) Date of Patent: May 1, 2018

(54) METHOD OF CONTROLLING LOCK PIN OF CONTINUOUSLY VARIABLE VALVE TIMING SYSTEM

(71) Applicants: Hyundai Motor Company, Seoul (KR); Kia Motors Corporation, Seoul (KR)

(72) Inventors: Chung Han Oh, Seongnam-si (KR); Min Su Park, Paju-si (KR); Yun Seok Kim, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 350 days.

(21) Appl. No.: 14/925,512

(22) Filed: Oct. 28, 2015

(65) Prior Publication Data

US 2016/0376941 A1 Dec. 29, 2016

(30) Foreign Application Priority Data

Jun. 26, 2015 (KR) ..... 10-2015-0091601

(51) Int. Cl.
*F01L 1/344* (2006.01)

(52) U.S. Cl.
CPC ..... *F01L 1/3442* (2013.01); *F01L 2001/3443* (2013.01); *F01L 2001/34426* (2013.01); *F01L 2001/34433* (2013.01); *F01L 2001/34463* (2013.01); *F01L 2001/34466* (2013.01); *F01L 2001/34469* (2013.01)

(58) Field of Classification Search
CPC ..... F01L 1/3442; F01L 2001/34426; F01L 2001/3443; F01L 2001/34433; F01L 2001/34463; F01L 2001/34466; F01L 2001/34469
See application file for complete search history.

(56) References Cited

U.S. PATENT DOCUMENTS

| | | | | |
|---|---|---|---|---|
| 8,800,515 | B1 * | 8/2014 | Smith | F01L 1/34409 123/90.15 |
| 2002/0062803 | A1 * | 5/2002 | Sato | F01L 1/022 123/90.17 |
| 2013/0180486 | A1 * | 7/2013 | Smith | F01L 1/3442 123/90.17 |

FOREIGN PATENT DOCUMENTS

| | | |
|---|---|---|
| JP | 2001-041012 | 2/2001 |
| KR | 10-2009-0051577 | 5/2009 |
| KR | 10-2015-0039099 | 4/2015 |

* cited by examiner

*Primary Examiner* — Mark Laurenzi
*Assistant Examiner* — Wesley Harris
(74) *Attorney, Agent, or Firm* — Brinks Gilson & Lione

(57) ABSTRACT

A method of controlling a lock pin of a CVVT (continuous variable valve timing) system is provided. The method includes an oil supply operation of operating a spool of a valve bolt by means of oil drawn into the CVVT system and supplying the oil to the lock pin and a switching valve. The method further includes a switching-valve opening operation of opening the switching valve by means of pressure of the oil supplied in the oil supply operation, and a lock-pin releasing operation of supplying oil to a chamber when the switching valve opens and releasing the lock-pin when there is no difference in oil pressure between an advanced chamber and a retracted chamber.

8 Claims, 5 Drawing Sheets

METHOD OF CONTROLLING LOCK PIN OF CONTINUOUSLY VARIABLE VALVE TIMING SYSTEM

CROSS REFERENCE TO RELATED APPLICATION

The present application claims to the benefit of Korean Patent Application No. 10-2015-0091601, filed Jun. 26, 2015, which is incorporated herein by reference in its entirety.

FIELD

The present disclosure relates to a method of controlling a lock pin of a continuously variable valve timing (CVVT) system.

BACKGROUND

The statements in this section merely provide background information related to the present disclosure and may not constitute prior art.

Generally, CVVT systems are used in vehicles with the purposes of reducing exhaust gas, improving fuel efficiency, and enhancing output. Research on intermediate phase CVVT systems has recently been conducted with the goal of overcoming limits related to the responsiveness of a conventional CVVT system and a restrictive operation section. In the case of intermediate phase CVVT systems, the position of a cam is controlled at an intermediate position rather than a most advanced (intake) position or a most retarded (exhaust) position. Therefore, responsiveness is comparatively high, and the range within which the cam is available can be increased. Thereby, fuel efficiency can be improved, and the amount of exhaust gas can be reduced.

Meanwhile, in an intermediate phase CVVT system, while the RPM of an engine is reduced, a lock pin installed adjacent to a rotor is locked to a lock-pin hole disposed at a medial position between the advanced chamber and the retarded chamber, thus being ready for subsequent ignition of the engine. Here, automatically locking the lock pin to the lock-pin hole while the RPM of the engine is reduced refers to a 'self-lock' state.

Self-locking functions to enable the CVVT to be mechanically returned to an accurate position without separate control so that reliable operation of the engine can be ensured in a non-operation area of the CVVT system, that is, when the vehicle is in an idle or ignition state.

However, we have discovered that if the valve timing remains at the most retarded position rather than returning to an intermediate phase, a surge tank is increased in pressure to the level of atmospheric pressure, rather than creating a vacuum when the vehicle is in an idle state. Therefore, a problem of deterioration of braking performance using the vacuum in the surge tank is caused.

Furthermore, we have discovered that if the valve timing remains at the most advanced position rather than returning to the intermediate phase, valve timing overlap between an intake valve and an exhaust valve is excessively frequently caused. Thus, the reliability of the operation of the engine is reduced. In addition, a problem of vibration of the engine is exacerbated. In some cases, a problem of engine stalling may be caused.

In other words, in the intermediate phase CVVT system, we have discovered that when the self-lock function of the lock pin is automatically conducted, as under normal conditions, and the rotor and the lock pin are thus in the most advanced or retarded position, a problem of engine stalling or a problem of malfunction of the brakes because of a lack of negative pressure is caused.

Furthermore, we have discovered that if a difference in oil pressure between the advanced chamber and the retarded chamber is caused when the locked state of the lock pin is released, side force is applied to the lock pin, thus causing a problem of the lock pin being undesirably removed from the locking hole. Further, once fatigue accumulates on the lock pin, a problem of damage to the lock pin may be caused.

The foregoing is intended merely to aid in the understanding of the background of the present disclosure, and is not intended to mean that the foregoing is already known to those skilled in the art.

SUMMARY OF THE INVENTION

The present disclosure provides a method of controlling a lock pin of a CVVT system which can prevent problems, in which if a difference in oil pressure between an advanced chamber and a retarded chamber is caused when a locked state of a lock pin is released, side force is applied to the lock pin whereby the lock pin may be undesirably removed from the locking hole or the lock pin may be damaged by fatigue accumulation.

The present disclosure provides a method of controlling a lock pin of a continuous variable valve timing (CVVT) system, the method including: an oil supply operation of operating a spool of a valve bolt by means of oil drawn into the CVVT system, and supplying the oil to the lock pin and a switching valve; a switching-valve opening operation of opening the switching valve by means of pressure of the oil supplied in the oil supply operation; and a lock-pin releasing operation of supplying oil to a chamber when the switching valve opens, and releasing the lock pin when there is no difference in oil pressure between an advanced chamber and a retarded chamber.

The oil supply operation may include supplying the oil from an oil control valve (OCV) and forming an oil passage through the valve bolt so that the oil is supplied to the lock pin and the switching valve.

The lock-pin releasing operation may include adjusting a duty value of the OCV so that the oil is evenly supplied to the advanced chamber and the retarded chamber.

A switching-valve spring provided on the switching valve and a lock-pin spring provided on the lock pin may be set such that a stiffness of the switching-valve spring is less than a stiffness of the lock-pin spring, whereby opening the switching valve precedes releasing the lock pin.

The maximum stiffness of a switching-valve spring provided on the switching valve may be set to be less than the minimum stiffness of a lock-pin spring provided on the lock pin, so that opening the switching valve precedes releasing the lock pin.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
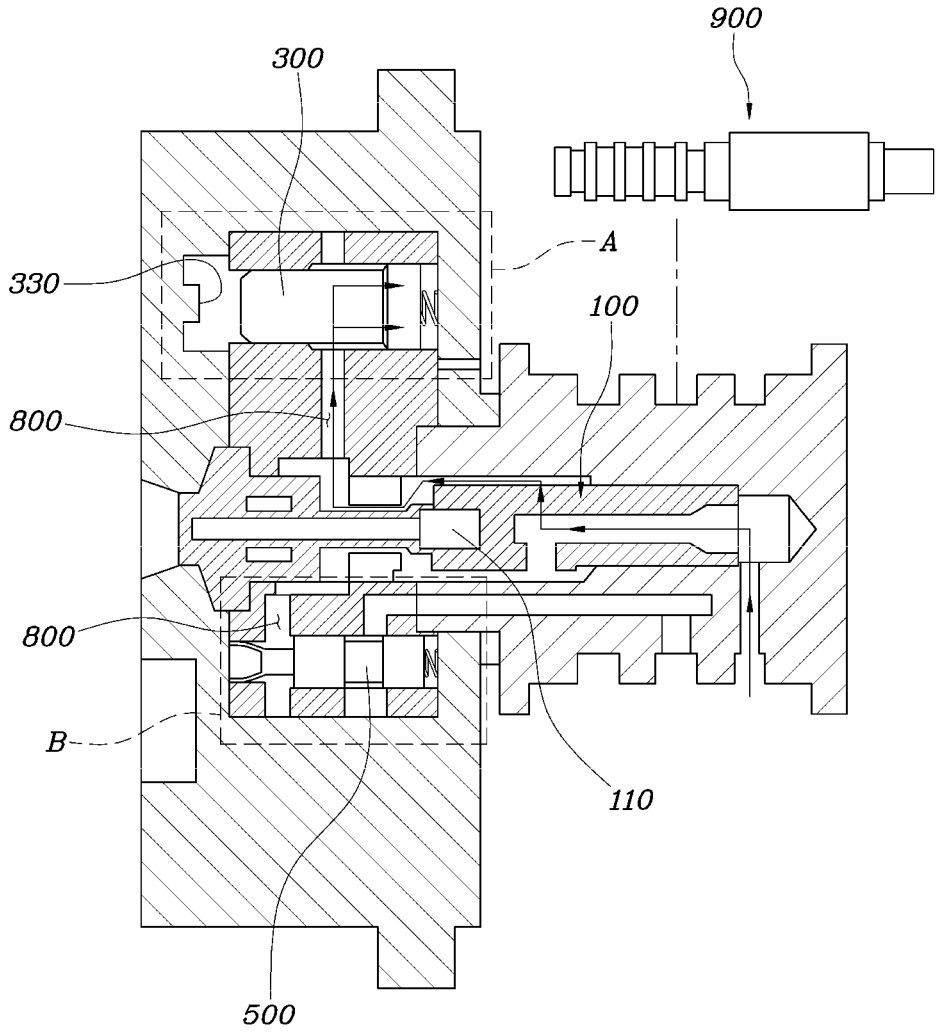
FIG. 1 is a view illustrating a CVVT system according to an embodiment of the present disclosure.
Figure 2:
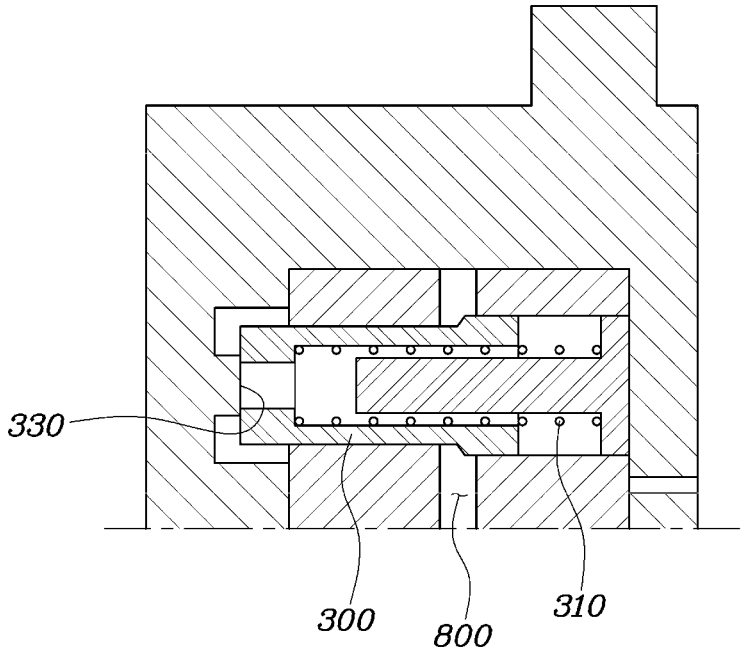
FIG. 2 is a view showing an enlargement of portion A of FIG. 1.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features. A method of controlling a lock pin of a CVVT system according to an embodiment of the present disclosure will be described in detail with reference to the drawings.

Figure 4:
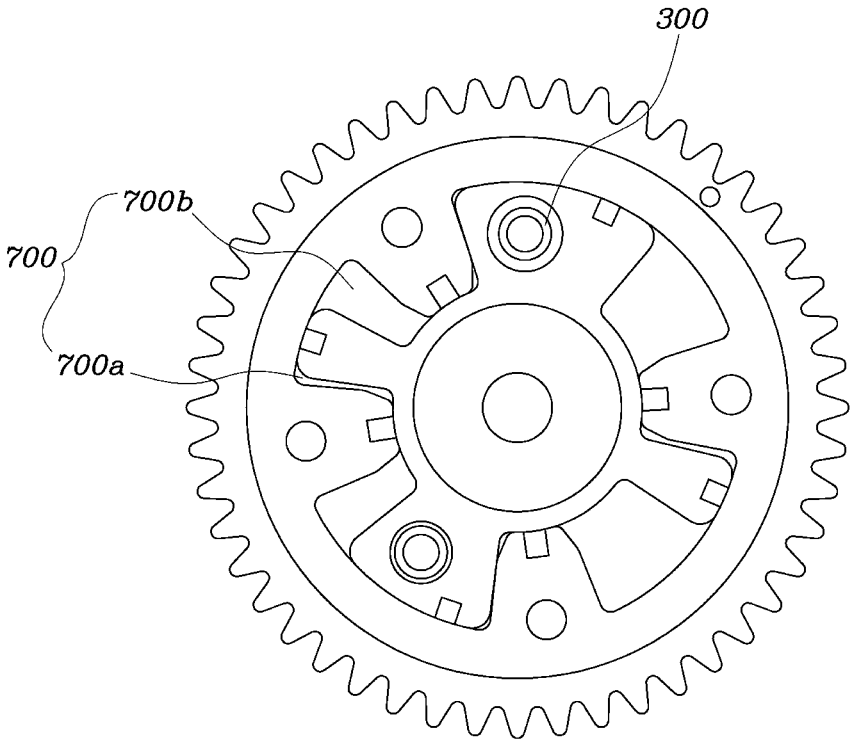
FIG. 4 is a view showing a chamber according to an embodiment of the present disclosure.
Figure 5:
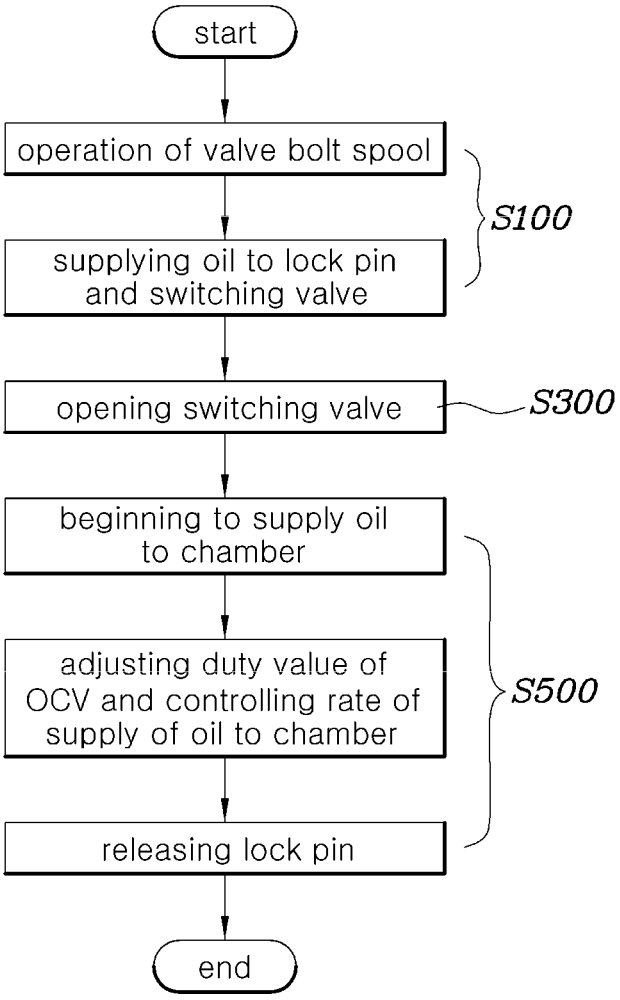
FIG. 5 is a flowchart showing a method of controlling a lock pin of the CVVT system according to an embodiment of the present disclosure.

With reference to FIGS. 1 and 5, the method of controlling a lock pin of a CVVT system according to an embodiment of the present disclosure includes: an oil supply operation S100 of operating a spool 110 of a valve bolt 100 by means of oil drawn into the CVVT system and supplying the oil to the lock pin 300 and a switching valve 500; a switching-valve opening operation S300 of opening the switching valve 500 by means of pressure of the oil supplied in the oil supply operation S100; and a lock-pin releasing operation S500 of supplying oil to chamber 700 (FIG. 4) when the switching valve 500 opens and releasing the lock pin 300 when there is no difference in oil pressure between an advanced chamber 700*a* and a retarded chamber 700*b*.

AS best seen in FIG. 1, in an intermediate phase CVVT system, oil is supplied from an oil control valve (OCV) 900 to control the lock pin 300. Oil supplied from the OCV 900 is supplied to the valve bolt 100. Thereby, the spool 110 of the valve bolt 100 is operated so that an oil passage 800, through which oil is supplied to the lock pin 300 and the switching valve 500, is formed between the spool 110 and the outer surface of the valve bolt 100. In this way, the oil supply operation S100 of supplying oil to the lock pin 300 and the switching valve 500 is conducted.

As stated above, the switching valve 500 opens or closes the oil passage 800 along which oil supplied from the OCV 900 is moved. When the oil passage 800 opens, oil can be simultaneously supplied to both the lock pin 300 and the switching valve 500. In this embodiment, although oil has been illustrated as being supplied through the OCV 900, oil may be supplied through a cylinder block or head, or a cam shaft when needed. This modification can be changed in a variety of ways depending on design conditions.

Figure 3:
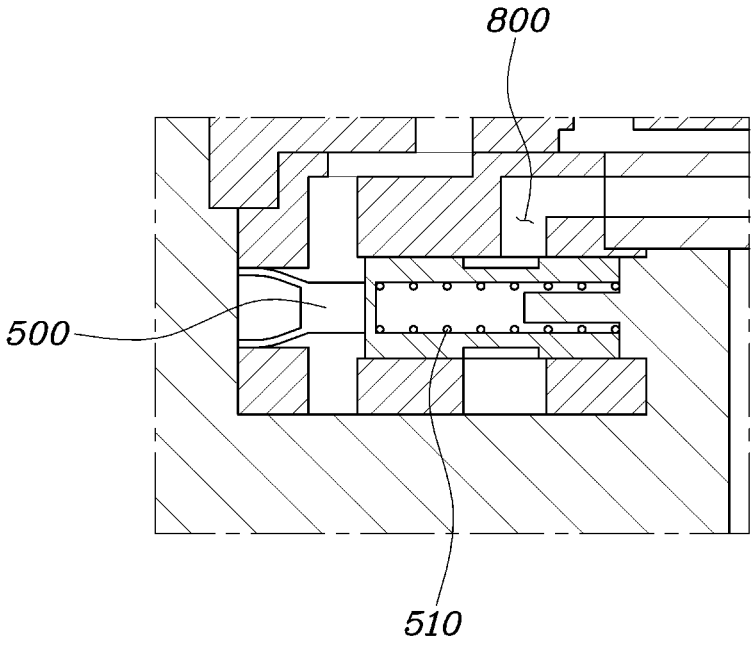
FIG. 3 is a view showing an enlargement of portion B of FIG. 1.

In the switching-valve opening operation S300, the switching valve 500 is gradually opened by the pressure of oil supplied in the oil supply operation S100. It is preferable that the switching valve 500 be opened by oil pressure and, when the oil pressure is removed, the switching valve 500 be elastically returned to its original state by a switching-valve spring 510 provided in the switching valve 500. In the switching valve 500, the timing at which the switching valve 500 is opened or closed can be controlling by adjusting the stiffness of the switching-valve spring 510 (FIG. 3). As such, in the present disclosure, the timing at which the switching valve 500 and the lock pin 300 open can be respectively controlled by adjusting the stiffness of springs 310 and 510.

When the switching valve 500 opens in the switching-valve opening operation S300, oil is supplied to the chamber 700 (FIG. 4). Here, in the advanced chamber 700*a* and the retarded chamber 700*b*, the duty value of the OCV 900 is adjusted so that oil can be evenly supplied to the chamber 700. When the difference in oil pressure between the advanced chamber 700*a* and the retarded chamber 700*b* becomes zero or approaches zero, the lock pin 300 is removed from a locking hole 330 by the supplied oil so that the locked state is released. In this way, the lock-pin releasing operation S500 is conducted.

The lock-pin spring 310 is provided on the locking pin 300. The lock pin 300 is elastically inserted into a lock-pin hole 300 by a self-locking operation. When it is required to release the locked state, the pressure of oil supplied from the OCV 900 is used. In the conventional technique, even when there is a difference in oil pressure between the chamber 700 (the advanced chamber 700*a* and the retarded chamber 700*b*), the locked state of the lock pin can be released. In this case, side force may be applied to the lock pin, whereby failure to release the locked state may be caused. Furthermore, fatigue consecutively accumulates on the lock pin because of the failure to release the locked state. The lock pin may be deformed or damaged by accumulated fatigue. To overcome this problem, the present disclosure is configured such that oil can be evenly supplied to the advanced chamber 700*a* and the retarded chamber 700*b* so that the pressures in the chamber 700 (the advanced chamber 700*a* and the retarded chamber 700*b*) can become equal to each other. Therefore, side force applied to the lock pin 300 is removed, thus enabling the lock pin 300 to be easily removed from the lock-pin hole 330. Thereby, the problem, in which the lock pin 300 is deformed or damaged by fatigue accumulated on the lock pin 300 because of failure to release the lock pin 300, can be solved.

In particular, in order to eliminate side force applied to the lock pin 300, it is important to evenly distribute the oil pressure to the advanced chamber 700*a* and the retarded chamber 700*b*. For this, the switching valve 500 opens before oil pressure is applied to the lock pin 300, so that the oil passage 800 forms a single closed loop. Consequently, the pressure in the oil passage 800 can be maintained even, as per Pascal's law.

To achieve the above-mentioned purpose, the switching valve 500 must open before the locked state of the lock pin 300 is released. In order to open the switching valve 500 before the locked state of the lock pin 300 is released, oil pressure must be able to easily overcome the stiffness of the switching-valve spring 510, which elastically biases the switching valve 500 in the direction in which the switching valve 500 is closed. Therefore, the stiffness of the switching-valve spring 510 provided on the switching valve 500 is set to be comparatively soft. In detail, the stiffness of the switching-valve spring 510 is set to be less than that of the lock-pin spring 310 provided on the lock pin 300. In this case, the locked state of the lock pin 300 is released after the switching valve 500 is opened, even though the same oil pressure is applied to the switching valve 500 and the lock pin 300.

Particularly, and more precisely, the maximum stiffness of the switching-valve spring 510 provided on the switching valve 500 is set to be less than the minimum stiffness of the lock-pin spring 310 provided on the lock pin 300. Thus, opening the switching valve 500 always precedes releasing the locked state of the lock pin 300. Therefore, when the locked state of the lock pin 300 is released, side force, which was caused on the lock pin 300 in the conventional technique, can be eliminated. As a result, the present disclosure can eliminate failure to release the locked state and fundamentally prevent the lock pin 300 from being deformed or damaged.

As described above, in a method of controlling a lock pin of a CVVT system according to the present disclosure, a switching-valve spring provided on a switching valve and a lock-pin spring provided on a lock pin are set such that the stiffness of the switching-valve spring is less than that of the lock-pin spring. Thus, opening the switching valve always precedes releasing the locked state of the lock pin. Particularly, the maximum stiffness of the switching-valve spring provided on the switching valve is set to be less than that minimum stiffness of the lock-pin spring provided on the lock pin. Thereby, the switching valve can always be opened before the locked state of the lock pin is released. Therefore, the present disclosure can eliminate side force, which was caused on the lock pin in the conventional technique, thus removing failure to release the locked state and fundamentally preventing the lock pin from being deformed or damaged.

Although the exemplary embodiment of the present disclosure has been disclosed for illustrative purposes, those skilled in the art will appreciate that various modifications, additions and substitutions are possible, without departing from the scope and spirit of the disclosure as disclosed in the accompanying claims.

What is claimed is:

1. A method of controlling a lock pin of a continuous variable valve timing (CVVT) system, comprising:

an oil supply operation of operating a spool of a valve bolt utilizing oil drawn into the CVVT system, and supplying the oil to the lock pin and a switching valve;

a switching-valve opening operation of opening the switching valve by means of pressure of the oil supplied in the oil supply operation; and a lock-pin releasing operation of supplying oil to a chamber when the switching valve opens, and releasing the lock pin when there is no difference in oil pressure between an advanced chamber and a retarded chamber.

2. The method as set forth in claim 1, wherein the oil supply operation comprises supplying the oil from an oil control valve (OCV) and forming an oil passage through the valve bolt so that the oil is supplied to the lock pin and the switching valve.

3. The method as set forth in claim 1, wherein the lock-pin releasing operation comprises adjusting a duty value of the OCV so that the oil is evenly supplied to the advanced chamber and the retarded chamber.

4. The method as set forth in claim 1, wherein a switching-valve spring is provided on the switching valve, and a lock-pin spring is provided on the lock pin, and wherein the springs are set such that a stiffness of the switching-valve spring is less than a stiffness of the lock-pin spring, whereby opening the switching valve precedes releasing the lock pin.

5. The method as set forth in claim 1, wherein a maximum of a stiffness of a switching-valve spring provided on the switching valve is set to be less than a minimum of a stiffness of a lock-pin spring provided on the lock pin, so that opening the switching valve precedes releasing the lock pin.

6. A method of controlling a lock pin of a continuous variable valve timing (CVVT) system drawing in oil, the CVVT system including a valve bolt having a spool, a locking pin, a switching valve, and a chamber having an advanced chamber and a retarded chamber, the method comprising:

operating the spool of the valve bolt utilizing the oil;

supplying the oil to the lock pin and the switching valve;

opening the switching valve by utilizing the oil supplied to the lock pin and the switching valve;

supplying oil to the chamber when the switching valve opens; and releasing the lock pin when there is no difference in oil pressure between the advanced chamber and the retarded chamber.

7. The method as set forth in claim 6, wherein a switching-valve spring is provided on the switching valve, and a lock-pin spring is provided on the lock pin, and wherein the springs are set such that a stiffness of the switching-valve spring is less than a stiffness of the lock-pin spring, whereby opening the switching valve precedes releasing the lock pin.

8. The method as set forth in claim 6, wherein a maximum of a stiffness of a switching-valve spring provided on the switching valve is set to be less than a minimum of a stiffness of a lock-pin spring provided on the lock pin, so that opening the switching valve precedes releasing the lock pin.

* * * * *